US008997763B2

(12) United States Patent
Koehler et al.

(10) Patent No.: US 8,997,763 B2
(45) Date of Patent: Apr. 7, 2015

(54) BIN WASHING SYSTEM

(75) Inventors: Matthew Koenen Koehler, Meservey, IA (US); Jim David Brozik, Garner, IA (US); Matthew Wendell Schroeder, Ventura, IA (US)

(73) Assignee: Stellar Industries, Inc., Garner, IA (US)

( * ) Notice: Subject to any disclaimer, the term of this patent is extended or adjusted under 35 U.S.C. 154(b) by 360 days.

(21) Appl. No.: 13/465,491

(22) Filed: May 7, 2012

(65) Prior Publication Data

US 2013/0291894 A1 Nov. 7, 2013

(51) Int. Cl.
*B08B 9/093* (2006.01)

(52) U.S. Cl.
CPC ..... *B08B 9/093* (2013.01)

(58) Field of Classification Search
CPC ..... B08B 9/0804
USPC ..... 134/10, 22.1, 104.1, 104.2, 104.4, 109, 134/110, 111, 166 R–166 C
See application file for complete search history.

(56) References Cited

U.S. PATENT DOCUMENTS

| | | | | | |
|---|---|---|---|---|---|
| 2,213,627 | A | * | 9/1940 | De Baugh | 134/167 R |
| 3,448,745 | A | * | 6/1969 | Seeley | 134/103.1 |
| 4,104,164 | A | * | 8/1978 | Chelton | 210/136 |
| 4,135,533 | A | * | 1/1979 | Gall et al. | 134/104.4 |
| 4,242,311 | A | | 12/1980 | Middaugh | |
| 4,512,811 | A | * | 4/1985 | Binnig et al. | 134/10 |
| 4,934,393 | A | | 6/1990 | Lighthall | |
| 5,277,209 | A | | 1/1994 | Olson | |
| 5,392,797 | A | * | 2/1995 | Welch | 134/108 |
| 5,964,229 | A | | 10/1999 | Brendel | |
| 6,336,239 | B1 | | 1/2002 | Cooper | |
| 6,818,070 | B2 | | 11/2004 | Rosenberg | |
| 7,225,816 | B2 | | 6/2007 | Byers | |
| 7,398,789 | B1 | | 7/2008 | Herrera | |
| 7,846,263 | B1 | | 12/2010 | Marcantel | |
| 8,118,948 | B1 | | 2/2012 | Szabo | |
| 2006/0090776 | A1 | * | 5/2006 | Watford | 134/33 |
| 2007/0199903 | A1 | | 8/2007 | Denney | |
| 2007/0221552 | A1 | | 9/2007 | Denney | |
| 2008/0035176 | A1 | | 2/2008 | Byers | |
| 2008/0105474 | A1 | | 5/2008 | Byers | |

(Continued)

FOREIGN PATENT DOCUMENTS

| | | |
|---|---|---|
| DE | 202008016374 | 6/2009 |
| DE | 102010021239 | 11/2011 |

*Primary Examiner* — David Cormier
(74) *Attorney, Agent, or Firm* — Camille L. Urban; David M. Breiner; G. Brian Pingel

(57) ABSTRACT

Provided is an example of bin washing system. The bin washing system may include a first solid-liquid separating device, a second solid-liquid separating device, a pump, and an inlet structure. The first solid-liquid separating device may be configured to receive a first solid-liquid suspension having first solids and second solids, separate the first solids from the second solids, and dispatch a second solid-liquid suspension having the second solids. The second solid-liquid separating device may be configured to receive the second solid-liquid suspension, capture the second solids, and dispatch cleaned water. The pump may be configured to pump cleaning water to the first solid-liquid separating device. The inlet structure may be configured to receive waste water that includes the first and second solids. The bin washing system may be configured to combine the cleaning water pumped by the pump with the waste water to form the first solid-liquid suspension.

14 Claims, 5 Drawing Sheets

(56) References Cited

U.S. PATENT DOCUMENTS

2008/0105761 A1 5/2008 Amestoy
2008/0110476 A1 5/2008 Amestoy
2009/0288679 A1 11/2009 Pietsch et al.
2010/0206331 A1 8/2010 Shuman

* cited by examiner

BIN WASHING SYSTEM

BACKGROUND

1. Field

Example embodiments relate to a bin washing system and a method of cleaning the bin. Example embodiments also relate to a mobile bin washing system configured to wash the bin.

2. Description of the Related Art

The average American family produces about forty pounds of trash weekly. This trash is generally stored in trash receptacles, for example, trash cans or bins, which are emptied by a trash collection service on a regular basis. Generally, the trash collection service employs a truck having a compartment into which contents of a trash receptacle are dumped. Typically, an employee of the trash collection service grabs the trash receptacle and turns it upside down so that trash in the receptacle falls out of the trash receptacle and into the compartment under the force of gravity. Such services, however, generally do not clean the inside of the trash receptacle. Thus, any trash which is adhered to the inside of the trash receptacle is generally not removed during the trash collection process. In the event the adhered trash is organic, the organic matter may decompose creating a foul odor inside the trash receptacle which may not only be unpleasant for those near the trash receptacle, but may create a health hazard as well.

SUMMARY

Example embodiments relate to a bin washing system and a method of cleaning the bin. Example embodiments also relate to a mobile bin washing system configured to wash bins.

In accordance with example embodiments, a bin washing system may include a first solid-liquid separating device, a second solid-liquid separating device, a pump, and an inlet structure. In example embodiments, the first solid-liquid separating device may be configured to receive a first solid-liquid suspension having first solids and second solids, separate the first solids from the second solids, and dispatch a second solid-liquid suspension having the second solids. The second solid-liquid separating device may be configured to receive the second solid-liquid suspension, capture the second solids, and dispatch cleaned water. The pump may be configured to pump cleaning water to the first solid-liquid separating device. The inlet structure may be configured to receive waste water that includes the first and second solids. In example embodiments, the bin washing system may be configured to combine the cleaning water pumped by the pump with the waste water to form the first solid-liquid suspension.

In accordance with example embodiments, the pump may receive water that is either clean or filtered. Thus, in service, the pump may always receive water which is substantially free of particulates. Because the pump may always receive water which is substantially free of particulates, damage to the pump may be reduced or minimized. Thus a service life of the pump operating in the bin washing system according to example embodiments may be relatively long.

In accordance with example embodiments, a mobile bin washing system may include a chassis upon which a bin washing system is mounted. In accordance with example embodiments, the bin washing system may include a first solid-liquid separating device, a second solid-liquid separating device, a pump, and an inlet structure. In example embodiments, the first solid-liquid separating device may be configured to receive a first solid-liquid suspension having first solids and second solids, separate the first solids from the second solids, and dispatch a second solid-liquid suspension having the second solids. The second solid-liquid separating device may be configured to receive the second solid-liquid suspension, capture the second solids, and dispatch cleaned water. The pump may be configured to pump cleaning water to the first solid-liquid separating device. The inlet structure may be configured to receive waste water that includes the first and second solids. In example embodiments, the bin washing system may be configured to combine the cleaning water pumped by the pump with the waste water to form the first solid-liquid suspension.

In accordance with example embodiments, a method of washing a bin may include providing the bin, spraying an inside of the bin with water to form wastewater having first and second solids therein, passing the wastewater to a first solid-liquid separating device, separating the first solids from the wastewater to form a first solution of water comprised of the second solids, separating the second solids in the first solution of water to form a second solution of water which is substantially free of the second solids, passing the second solution of water to a first tank, and pumping water from the first tank to the first solid-liquid separating device.

BRIEF DESCRIPTION OF THE DRAWINGS

Example embodiments are described in detail below with reference to the attached drawing figures, wherein.

DETAILED DESCRIPTION

Figure 1:
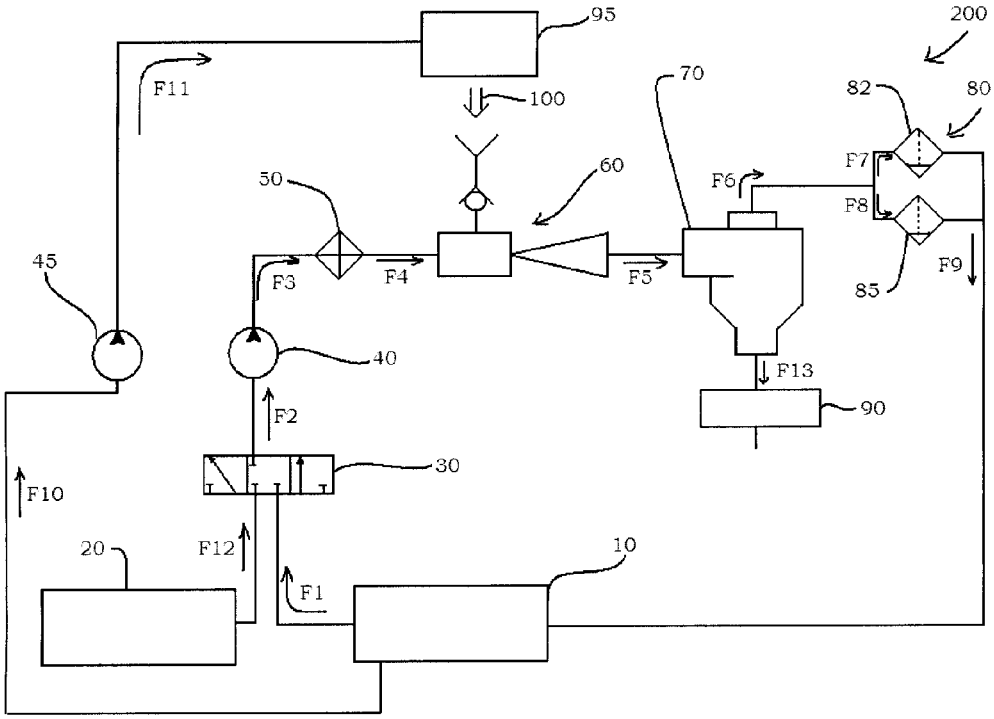
FIG. 1 is schematic view of a bin cleaning system in accordance with example embodiments.

Example embodiments will now be described more fully with reference to the accompanying drawings, in which example embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the sizes of components may be exaggerated for clarity.

It will be understood that when an element or layer is referred to as being "on," "connected to," or "coupled to" another element or layer, it can be directly on, connected to, or coupled to the other element or layer or intervening elements or layers that may be present. In contrast, when an element is referred to as being "directly on," "directly connected to," or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, and/or section from another elements, component, region, layer, and/or section. Thus, a first element component region, layer or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Embodiments described herein will refer to plan views and/or cross-sectional views by way of ideal schematic views. Accordingly, the views may be modified depending on manufacturing technologies and/or tolerances. Therefore, example embodiments are not limited to those shown in the views, but include modifications in configurations formed on the basis of manufacturing process. Therefore, regions exemplified in the figures have schematic properties and shapes of regions shown in the figures exemplify specific shapes or regions of elements, and do not limit example embodiments.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments relate to a bin washing system a method of cleaning the bin. Example embodiments also relate to a mobile bin washing system configured to wash trash receptacles such as bins and cans.

FIG. 1 is a schematic diagram of a bin washing system 200 in accordance with example embodiments. As will be explained shortly, the bin washing system 200 includes a bin washer 95 which may be configured to wash an inside of a bin, for example, a trash bin. The bin washer may include a nozzle through which water may be sprayed. Water leaving the nozzle may contact inside surfaces of the bin under a relatively high pressure. Thus, the water leaving the nozzles may clean the inside of the bin. In operation, the water cleaning the inside of the bin may mix with solids that were adhered to the inside surfaces of the bin. In example embodiments, this combination of water and solids leaving the bin is considered waste water 100. In example embodiments, the waste water enters the bin washing system 200 through an inlet structure 60. Solids in the waste water are captured by passing it through various solid-liquid separating devices. The wastewater that has the solids removed is considered "cleaned" water and the "cleaned" water is dispatched to a tank 10. In example embodiments, the tank 10 may be in communication with a pump 45 which may be a high pressure pump. The pump 45 may draw water from the tank 10 and pump it to the bin washer 95 where it is used once again to wash the inside of the bin. Thus, the bin washing system 200 in accordance with example embodiments recycles water that is used in a bin cleaning operation.

In example embodiments, the bin washing system 200 may include a first tank 10 which may be used to store cleaning water. By way of example only, the cleaning water may be regular tap water, water treated with an antibiotic, water treated with an anti-fungal chemical, or water treated with a detergent. In example embodiments, the first tank 10 may be in fluid communication with a first pump 40 and a second pump 45. In example embodiments, the first pump 40 may be a low pressure pump and the second pump 45 may be a high pressure pump. In example embodiments, the second pump 45 may be connected to the bin washer 95. Thus, in operation, the second pump 45 may pump cleaning water from the first tank 10 to the bin washer 95. In example embodiments, the bin washer 95 may include a nozzle which may be configured to spray the cleaning water onto surfaces of a trash bin to clean the trash bin. Also, as is apparent from FIG. 1, cleaning water may be also be pumped from the first tank 10 via the first pump 40.

Referring back to FIG. 1, the bin washing system 200 may also include a second tank 20. The second tank 20 may be filled with a rinse water. The rinse water may be used to clean various components of the bin washing system 200. By way of example only, the rinse water may include water treated with an anti-fungal chemical, water treated with an antibiotic, or water treated with a detergent. On the other hand, the rinse water may simply be relatively pure water such as tap or filtered water.

In example embodiments, a flow F1 of cleaning water from the first tank 10 and a flow F12 of rinse water from the second tank 20 may be controlled by a first control device 30. In example embodiments, the first control device 30 may be a valve. As shown in FIG. 1, the first control device 30 may be configured to allow the cleaning water to be pumped from the first tank 10 to the first pump 40 or to prevent the cleaning water from flowing from the first tank 10 to the first pump 40. Similarly, first control device 30 may be configured to allow the rinse water to be pumped from the second tank 20 to the first pump 40 or to prevent the rinse water from flowing from the second tank 20 to the first pump 40.

In example embodiments, a flow of water F2 (which may be comprised of either rinse water or cleaning water depending on an operation of the first control device 30) may enter a suction side of the first pump 40 and may exit a discharge side of the first pump 40 as another flow of water F3. In example embodiments, the flow of water F3 may either be comprised of rinse water or cleaning water depending on an operation of the first control device 30. In example embodiments, the flow F3 of water may pass through a heat exchanger 50 to form a heated flow of water F4. The heated flow of water F4 may have a higher cleaning capacity by virtue of its elevated temperature. In addition, because the flow of water circulating through the bin washing system 200 may be heated, a temperature of water F11 flowing to a bin washer 95 may also be elevated. Thus, a capacity to clean a surface of a trash bin may also be increased. In addition, the flow F3 of water may be heated to above 140 F in order kill bacteria that may be present in the flow F3 of water. In example embodiments, it is not necessary to heat the flow F3 of water to implement this invention, thus, a heat exchanger 50 may be omitted. However, passing the flow of water F3 through a heat exchanger 50 which is connected to hydraulic lines has the advantage of not only heating the flow of water F3 but of cooling the hydraulic fluid running through the hydraulic lines as well.

In example embodiments, the bin washing system 200 may include an inlet structure 60 into which wastewater 100 from a bin cleaning operation may flow. In example embodiments, the inlet structure 60 may include components which allow the waste water 100 to combine with the flow F4 of water to produce a first solid-liquid suspension F5.

Figure 2:
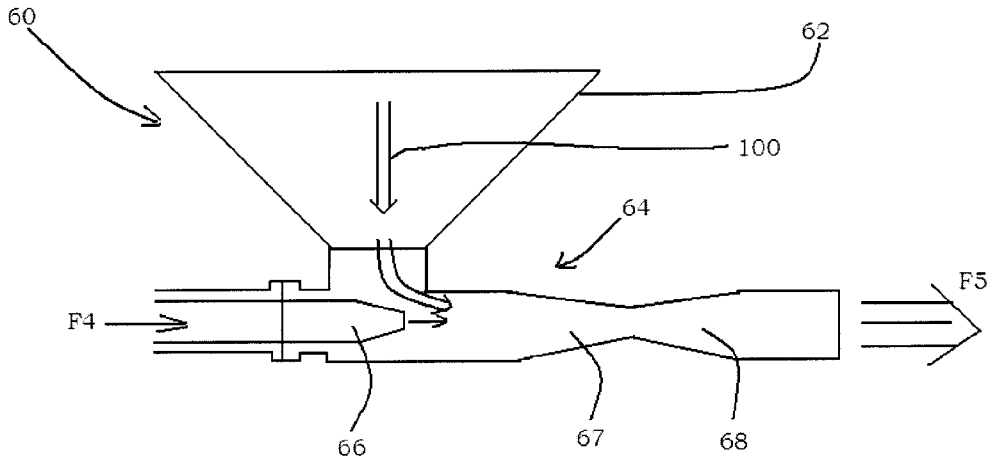
FIG. 2 is a view of an inlet structure in accordance with example embodiments.

FIG. 2 is illustrates a nonlimiting example of the inlet structure 60 according to example embodiments. As shown in FIG. 2, the inlet structure 60 may include a hopper 62 into which wastewater 100 from a cleaning operation may be poured. In example embodiments the inlet structure 60 may also include an eductor 64 which may be connected to the hopper 62 as is shown in FIG. 2. In example embodiments, the hopper 62 may be directly connected to an inlet of the eductor 64 or, in the alternative, by an interposing structure such as a pipe or tube. In example embodiments, interposing structures such as check valves may also be interposed between the hopper 62 and the eductor 64, though example embodiments are not limited thereto.

In example embodiments the eductor 64 may include a fluid nozzle 66 into which the flow F4 of water may flow. As is well understood in the eductor art, the flow F4 of water may act as a motive fluid which draws the waste water 100 through the inlet of the eductor 64, through a converging inlet nozzle 67 of the eductor 64, and out a diverging outlet 68 of the eductor 64. In the eductor 64, the flow F4 of water may combine with the wastewater 100 to produce a first solid-liquid suspension F5. The first solid-liquid suspension F5 may be a suspension which includes the flow F4 of water and the solids and water from the wastewater 100.

Referring back to FIG. 1, the first solid-liquid suspension F5 may be pumped to a first solid-liquid separating device 70 by the first pump 40. The first solid-liquid separating device 70 may be configured to remove at least some of the solids present in the first solid-liquid suspension F5. For example, the first solid-liquid suspension F5 may include solids having different sizes. For example, the solids may be comprised of a first group of solids (an example of a first solids) having a first density and/or size greater than a first value and a second group of solids (an example of second solids) having a second density and/or size less than the first value. In example embodiments, the first solid-liquid separating device 70 may be configured to remove the first group of solids from the first solid-liquid suspension F5 while allowing the second group of solids and the water in the first solid-liquid suspension F5 to pass therethrough as a second solid-liquid suspension F6. In other words, the second solid-liquid suspension F6 dispatched from by the first solid-liquid separating device 70 equals the first solid-liquid suspension F5 less the elements from the solid-liquid suspension F5 removed by the first solid-liquid separating device 70.

Figure 3:
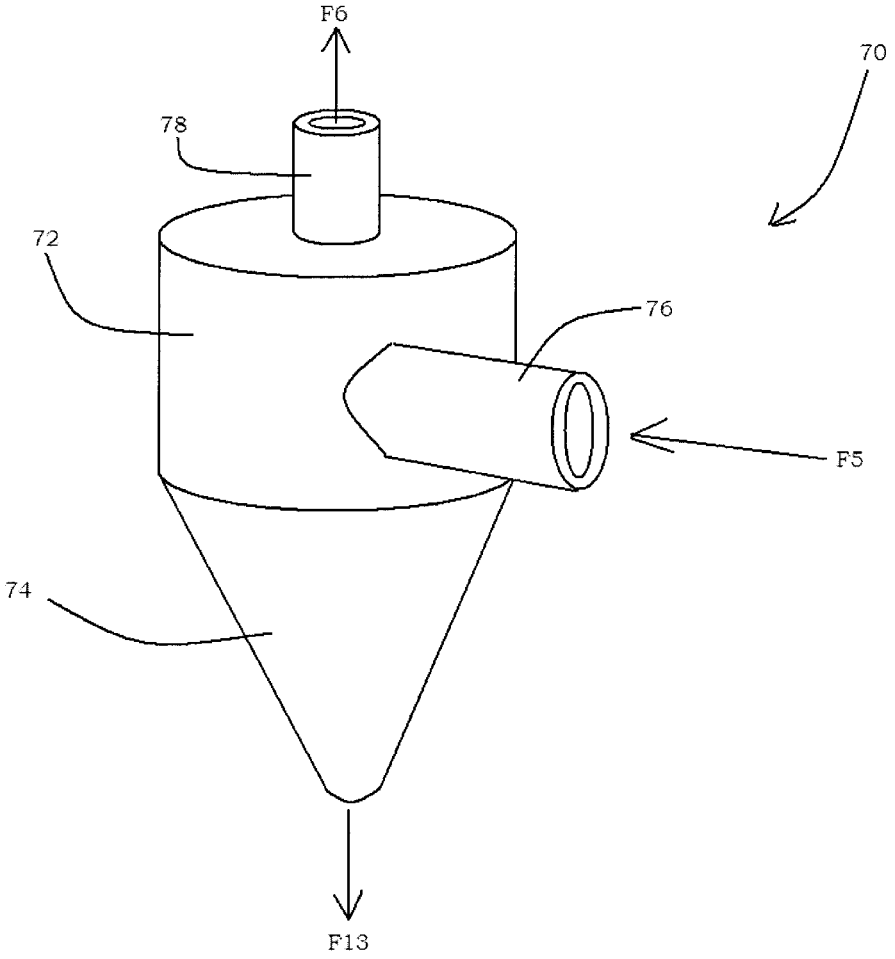
FIG. 3 is a view of a solid-liquid separating device in accordance with example embodiments.

In example embodiments, the first solid-liquid separating device 70 may be configured to apply a centripetal force to the first solid-liquid suspension F5. For example, the first solid-liquid separating device 70 may be hydrocylone, an example of which is shown in FIG. 3. In example embodiments, the hydrocylone may include a cylindrical section 72 into which the first solid-liquid suspension F5 may be pumped. In example embodiments, the first solid-liquid suspension F5 may enter the cylindrical section 72 via an inlet port 76. In example embodiments, the inlet port 76 may be arranged so that the first solid-liquid suspension F5 is fed tangentially into the cylindrical section 72. In example embodiments, a relatively heavy fraction of the first solid-liquid suspension F5 may exit the hydrocylone via a conical section 74 to form a discharge flow F13 whereas a relatively light fraction of the first solid-liquid suspension F5 may exit the hydrocyclone through an exit port 78 above the cylindrical section 72. In example embodiments, the relatively heavy suspension may include the first group of solids (the example of a first solids) having the first density and/or size greater than the first value whereas the relatively light suspension may include the second group of solids (the example of the second solids) having the second density and/or size less than the first value. In example embodiments, the portion of the first solid-liquid suspension F5 leaving the hydrocylone 70 through the exit port 78 constitutes the second solid-liquid suspension F6.

Example embodiments are not limited to an embodiment where the first solid-liquid separating device 70 is a hydrocylone. For example, the first solid-liquid separating device 70 may be a centrifuge. As another example, rather than providing a hydrocyclone, the first solid-liquid separating device 70 may be a filter having a pore size configured to screen out materials having a first size or greater while allowing the rest of the first solid-liquid suspension F5 to pass therethrough.

In example embodiments, the second solid-liquid suspension F6 leaving the first solid-liquid separating device 70 may be pumped to a second solid-liquid separating device 80. In example embodiments, the second solid-liquid device 80 may be configured to filter out a substantial portion of the second solids which were not removed from the first solid-liquid suspension F5 by the first solid-liquid separating device 70. For example, the second solid liquid separating device 80 may comprise at least one filter having a filter size sufficient to capture particles having a density or size above a second value. For example, the at least one filter may be a pool filter or a plurality of pool filters (e.g., two or more pool filters). In FIG. 1, the separating device 80 is illustrated as comprising a first pool filter 82 and a second pool filter 85 which may be configured to receive at least part of the second solid-liquid suspension F6. For example, the second solid-liquid suspension F6 may be connected to the first pool filter 82 and the second pool filter 85 by a T-connection which splits the second solid-liquid suspension F6 into a first flow F7 and a second flow F8. The first and second flows F7 and F8 may recombine after passing through the first and second pool filters 82 and 85 to form a third flow of water F9 which is substantially free of solids. As shown in FIG. 1, the third flow of water F9 may be pumped to the first tank 10.

Although the second solid-liquid separating device 80 shown in FIG. 1 is illustrated as being comprised of a first pool filter 82 in parallel with a second pool filter 85, the invention is not limited thereto. For example, the second solid-liquid separating device 80 may be comprised of a single filter. As another example, the second solid-liquid separating device 80 may be comprised of a plurality of filters that are in serial arrangement with one another other. As yet another example, the second solid-liquid separating device 80 may have more than two filters in parallel with each other. As yet another example, the second solid-liquid separating device 80 may be comprised of filters wherein some of the filters are arranged in parallel and while others filters are arranged in serial. In addition, the pool filters may be a media type filter such as a paper filter, a synthetic filter, a metal filter, or a combination thereof.

The system 200 is an efficient system which is usable for cleaning a bin, for example a garbage bin. For example, in example embodiments a bin may be placed in the washer bin 95. In example embodiments, the first pump 40 and the second pump 45 may be activated thus flowing water through the system 200. For example, when the first pump 40 is operating, cleaning water may be drawn from the tank 10, through the first control device 30, through the heat exchanger 50, through the first solid-liquid separating device 70, through the second solid-liquid separating device 80, and back to the tank 10 regardless as to whether the second pump 45 is operating. When the second pump 45 is operating, cleaning water may be pulled from the first tank 10 as a flow of cleaning water F10 and from the pump to the washer bin 95 as another flow F11 of water where it is sprayed onto surfaces of the bin. Water from the surfaces of the bin may carry with it solids of differing sizes thus forming the wastewater 100. The wastewater 100, as previously explained, may pass through the inlet structure 60 which may include a hopper and an eductor where it may be combined with the water pumped by the first pump 40 to form a first solid-liquid suspension F5 which may enter the first and second solid-liquid separators 70 and 80 to remove solids therein and form a substantially clean flow of water F9 which is returned to the first tank 10 for further cleaning operations.

In example embodiments, a fairly significant amount of first solids may be removed from the first solid-liquid suspension F5 by the first solid-liquid separator 70. The first solids may be flowed from the first liquid-separator 70 as the discharge flow F13 and stored in a third tank 90 which may serve as a sludge tank.

In example embodiments, the bin washing system 200 may be a static structure. For example, the bin washing system 200 may be incorporated into a building structure and users may bring the bins to the service for cleaning. On the otherhand, the bin washing system may be implemented as a mobile device as shown in FIG. 4.

Figure 4:
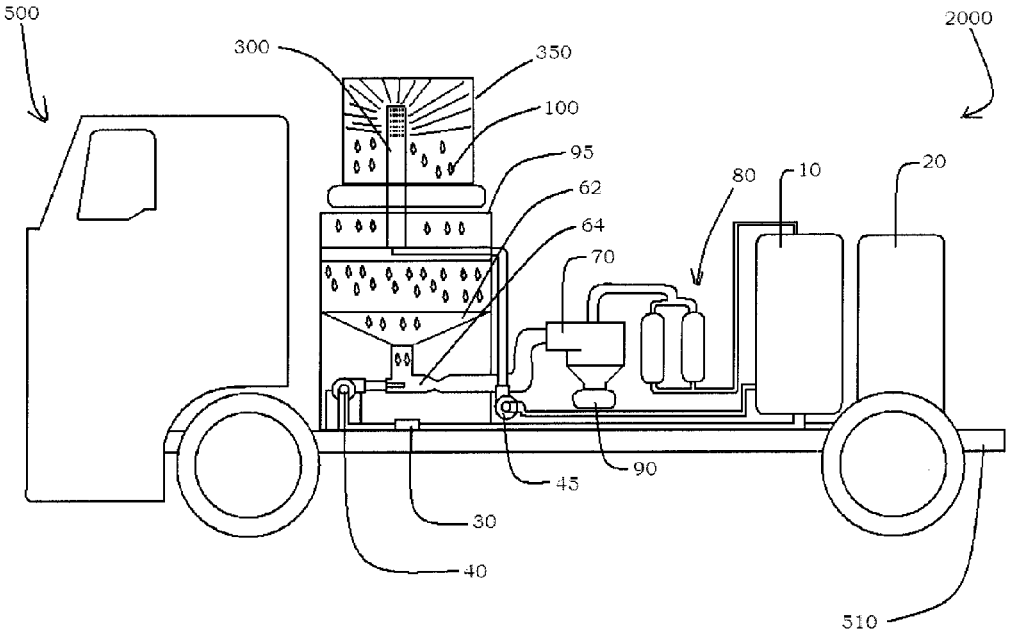
FIG. 4 if a view of a mobile bin cleaning apparatus in accordance with example embodiments.

FIG. 4 illustrates an example of a mobile bin washing system 2000. The mobile bin washing system may be substantially similar to the previously described bin washing system 200. Due to the similarity between the mobile bin washing system 2000 and the aforementioned bin washing system 200, only a brief description of the mobile bin washing system 2000 is provided for the sake of brevity.

Referring to FIG. 4, the mobile bin washing system 2000 may be a truck mounted system. In other words, the mobile bin washing system 2000 may be mounted on a chassis 510 of a truck 500. In example embodiments, the mobile bin washing system 2000 may include a first tank 10 for holding cleaning water and a second tank 20 for holding rinse water. As in the previous example, a first pump 40, for example, a low pressure pump, may draw either cleaning water or rinse water from the either the first tank 10 or the second tank 20 depending on a configuration of a control device 30. In example embodiments, the control device 30 of the mobile bin washing system 2000 may be substantially the same as the control device 30 of the bin washing system 200. Though not shown in FIG. 4, water pumped by the first pump 40 may pass through a heat exchanger which may heat the water. The pumped water may flow through a first and second solid-liquid separating device 70 and 80 and returned to the first tank 10 regardless as to whether a bin is being cleaned.

As shown in FIG. 4, the mobile bin washing system 2000 may include a second pump 45 which may be a high pressure pump. The second pump may draw cleaning water from the first tank 10 and may pump the cleaning water to a nozzle 300 where the cleaning water is ejected and sprayed onto inside surfaces of a bin 350. The water may combine with solids that may be present on inside surfaces of the bin 350 to form wastewater 100 which may flow into an inlet structure. As in the previous example, the inlet structure of the mobile bin washing system 2000 may be comprised of a hopper 62 and an eductor 64. In example embodiments, the waste water 100 entering the eductor is combined with water pumped by the first pump 40 to form a first solid-liquid mixture having solids of different sizes. The solids may be removed from the solid-liquid mixture by passing the solid liquid mixture through the first and second liquid separating devices 70 and 80 which may be substantially the same as the first and second solid liquid separating devices 70 and 80 of the bin washing system 200.

Figure 5:
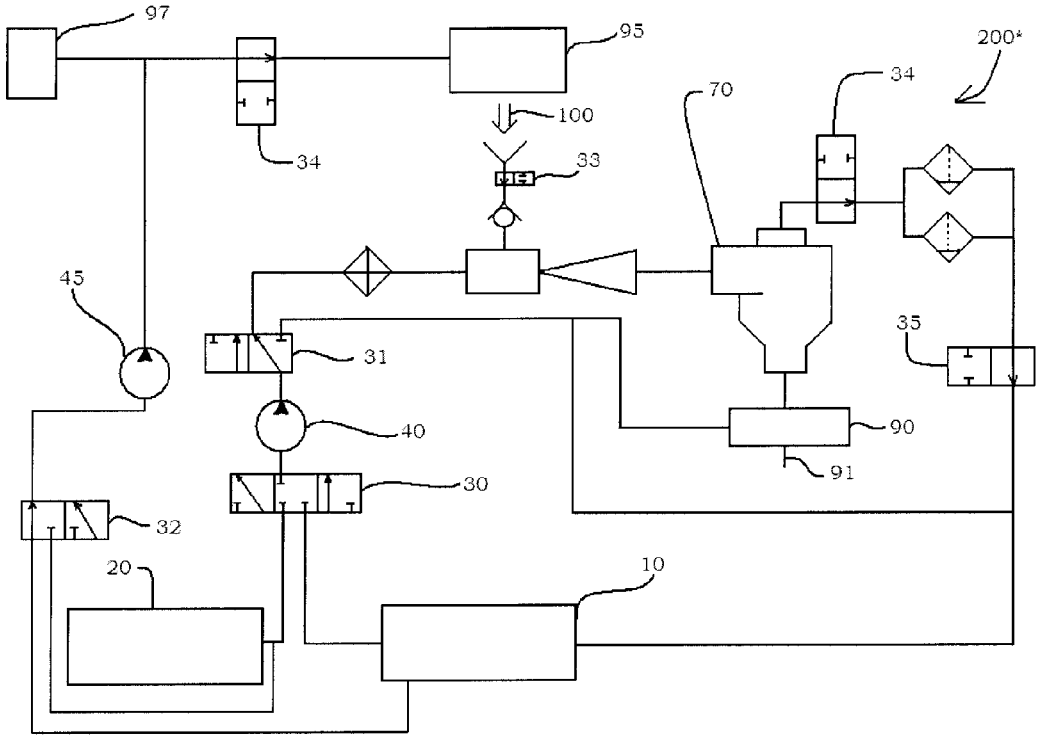
FIG. 5 is a schematic view of a bin cleaning system in accordance with example embodiments.

FIG. 5 is another example of a bin washing system 200* according to example embodiments. The bin washing system 200* illustrated in FIG. 5 may be substantially the same as the bin washing system 200 illustrated in FIG. 1, thus, only differences between the two systems will be emphasized.

Like the example bin washing system 200 illustrated in FIG. 1, the example bin washing system 200* illustrated FIG. 5 includes a first pump 40 which may be configured to pump either cleaning water or rinse water from either a first or second tank 10 and 20 depending on an operation of a first control device 30. In the bin washing system 200*, however, a second control device 31 may be provided on the discharge side of the first pump 40. The second control device 31 may be configured to direct either the cleaning water or the rinse water to one of the first solid-liquid separating device 70 and the third tank 90. As in the previous non-limiting example embodiments, the third tank 90 may be a tank configured to receive solids from the first solid-liquid separating device 70. By allowing the first pump 40 to flow water directly to the third tank 90, this nonlimiting example embodiment allows for the third tank 90 to be flushed out by action of the first pump 40. In example embodiments, the second control device 31 may be a valve.

In example embodiments, the bin washing system 200* may also include a third control device 32 between the first and second tanks 10 and 20 and the second pump 45. The third control device 32 may be configured to allow either rinse water from the second tank 20 to flow from the second tank 20 to the bin washer 95 under the influence of the second pump 45 or allow the cleaning water to flow from the first tank 10 to the bin washer 95 under the influence of the second pump 45. In example embodiments, the third control device 32 may be a valve.

In example embodiments, the second pump 45 of the bin washing system 200* may be a high pressure pump which may pump water from either the first tank 10 or the second tank 20 to the bin washer 95. However, in the bin washing system 200* of FIG. 5, the second pump 45 may be also pump the water to a hose wand 97 so that a bin may be washed by hand.

In example embodiments, the inlet device 33 of the bin washing system 200* may include a fourth control device 33. The fourth control device 33 may be a valve and may be configured to allow waste water 100 to pass through the inlet structure or obstruct the flow of wastewater 100 through the inlet structure 60. In example embodiments, the fourth control device 33 may be a valve.

In example embodiments, a fifth control device 34 may be provided between the second pump 45 and the bin washer 95. The fifth control device 34 may be a valve and may be configured to allow water to pass to the bin washer 95 or prevent water from passing to the bin washer 95. In example embodiments, the fifth control device 34 may be a valve.

In example embodiments, a sixth control device 35 may be provided between the second solid-liquid separating device 80 and the first tank 10. The sixth control device 35 may be a valve and may be configured to allow water to pass from the second solid-liquid separating device 80 to the first tank 10 or prevent water from flowing to the first tank 10 from the second solid-liquid separating device 80. In example embodiments, the sixth control device 35 may be a valve.

Though not explicitly stated, it is understood that the flow of water through the bin washing systems 200, 200*, and 200 may be facilitated by fluid transporting members such as pipes or tubes. For example, each of the flows F1, F2, F3, F4, F5, F6, F7, F8, F9, F10, F11, F12, and F13 may be flowed through pipes or tubes. For example, a pipe or a tube (or plurality of pipes or tubes or a combination thereof) may be used to flow water from the first tank 10 to the first control device 30 and from the first control device 30 to the first pump 40. The pipes or tubes may be made from a variety of materials such as copper, plastic, or rubber, though example embodiments are not limited thereto.

Example embodiments provide a bin cleaning system which has considerable advantages over the conventional art. For example, example embodiments provide for a bin cleaning system which may include an eductor in combination with a low pressure pump and a hydrocyclone to provide for a system in which clogging is reduced. Further, due to the novel and nonobvious arrangement of the low pressure pump, the eductor, and the hydrocyclone, cavitation of the pump is virtually eliminated.

While example embodiments have been particularly shown and described with reference to example embodiments thereof, it will be understood by those of ordinary skill in the art that various changes in form and details may be made therein without departing from the spirit and scope of the invention.

What we claim is:

1. A bin washing system comprising:

a first solid-liquid separating device configured to receive a first solid-liquid suspension having first solids and second solids, separate the first solids from the second solids, and dispatch a second solid-liquid suspension having the second solids;

a second solid-liquid separating device configured to receive the second solid-liquid suspension, capture the second solids, and dispatch cleaned water;

a pump configured to pump the cleaned water;

a hopper configured to receive waste water generated by spraying water on an inside of a bin;

an eductor configured to receive the waste water from the hopper and the cleaned water from the pump, wherein the waste water includes the first and second solids, the eductor is configured to combine the cleaned water pumped by the pump with the waste water to form the first solid-liquid suspension and the cleaned water pumped by the pump provides motive force to draw the waste water through the eductor; and a first tank configured to receive the cleaned water and provide the cleaned water to the pump.

2. The bin washing system according to claim 1, wherein the first solid-liquid separating device is configured to apply a centripetal force to the first solid-liquid suspension.

3. The bin washing system according to claim 2, wherein the second solid-liquid separating device comprises a media type filter.

4. The bin washing system according to claim 1, further comprising:

a second tank configured to hold rinse water; and a control device configured to provide one of the rinse and the cleaned water to the pump.

5. The bin washing system according to claim 1, further comprising:

a heat exchanger between the pump and the first solid-liquid separating device, wherein the heat exchanger is configured to heat the cleaned water pumped by the pump.

6. The bin washing system according to claim 5, wherein the heat exchanger is configured to flow heat from a hydraulic line to the cleaned water pumped by the pump.

7. The bin washing system according to claim 1, further comprising:

a high pressure pump configured to pump water to a bin washer.

8. The bin washing system according to claim 1, further comprising:

a tank configured to receive the first solids from the first solid-liquid separating device.

9. The bin washing system according to claim 1, further comprising:

a bin washer configured to spray an inside of a bin to produce the wastewater; and a high pressure pump configured to pump water to the bin washer.

10. The bin washing system according to claim 1, further comprising:

a second tank configured to receive the first solids from the first solid-liquid separating device; and a control device configured to direct the cleaned water pumped by the pump to at least one of the first solid-liquid separating device and the second tank.

11. A mobile bin washing system comprising:

a chassis upon which a bin washing system is mounted, the bin washing system comprising a first solid-liquid separating device configured to receive a first solid-liquid suspension having first solids and second solids, separate the first solids from the second solids, and dispatch a second solid-liquid suspension having the second solids, a second solid-liquid separating device configured to receive the second solid-liquid suspension, capture the second solids, and dispatch cleaned water, a pump configured to circulate the cleaned water to the first solid-liquid separating device, a hopper configured to receive waste water generated by spraying water on an inside of a bin, the waste water including the first and second solids;

an eductor configured to receive the waste water from the hopper that includes the first and second solids, wherein the bin washing system is configured to combine the cleaned water pumped by the pump with the waste water to form the first solid-liquid suspension and the cleaned water pumped by the pump provides motive force to draw the waste water through the eductor; and a first tank configured to receive the cleaned water and provide the cleaned water to the pump.

12. The mobile bin washing system according to claim 11, wherein the first solid-liquid separating device is a hydrocyl-cone.

13. The mobile bin washing system according to claim 12, wherein the second solid-liquid separating device is a pool filter.

14. The bin washing system of claim 1, wherein the hopper is at atmospheric pressure.

* * * * *